US012631108B2

(12) United States Patent
Shi et al.

(10) Patent No.: US 12,631,108 B2
(45) Date of Patent: May 19, 2026

(54) DATA LOGGER AND DATA ACQUISITION HYDRAULIC FRACTURING PROCESS

(71) Applicant: Zhejiang Tensing Science and Technology Co., Ltd., Ningbo (CN)

(72) Inventors: Zhaorui Shi, Ningbo (CN); Jiangyu Cao, Ningbo (CN); Chuyang Lin, Ningbo (CN); Jianwei Yin, Ningbo (CN)

(73) Assignee: Zhejiang Tensing Science and Technology Co., Ltd., Ningbo (CN)

( * ) Notice: Subject to any disclaimer, the term of this patent is extended or adjusted under 35 U.S.C. 154(b) by 0 days.

(21) Appl. No.: 19/183,683

(22) Filed: Apr. 18, 2025

(65) Prior Publication Data

US 2025/0250895 A1 Aug. 7, 2025

(51) Int. Cl.

| | |
|---|---|
| ***E21B 47/26*** | (2012.01) |
| ***E21B 33/12*** | (2006.01) |
| ***E21B 47/12*** | (2012.01) |

(52) U.S. Cl.

CPC ..... *E21B 47/26* (2020.05); *E21B 33/1208* (2013.01); *E21B 47/12* (2013.01)

(58) Field of Classification Search

CPC ..... E21B 47/26; E21B 33/1208; E21B 47/12

See application file for complete search history.

(56) References Cited

U.S. PATENT DOCUMENTS

| | | | | |
|---|---|---|---|---|
| 7,597,143 | B2 * | 10/2009 | Giacomino | E21B 47/017 166/250.11 |
| 7,690,425 | B2 * | 4/2010 | Giacomino | E21B 43/121 166/250.11 |
| 12,281,540 | B2 * | 4/2025 | Bin Ziad | G01L 19/086 |
| 2003/0205410 | A1 * | 11/2003 | Koch | E21B 44/00 175/45 |
| 2005/0178543 | A1 * | 8/2005 | Giacomino | E21B 47/01 166/250.01 |
| 2008/0110617 | A1 * | 5/2008 | Giacomino | E21B 47/01 166/162 |
| 2015/0129239 | A1 * | 5/2015 | Richard | E21B 33/128 166/195 |
| 2017/0328196 | A1 * | 11/2017 | Shi | E21B 47/138 |
| 2017/0328197 | A1 * | 11/2017 | Shi | E21B 47/138 |
| 2017/0350201 | A1 * | 12/2017 | Shi | E21B 47/07 |
| 2017/0350241 | A1 * | 12/2017 | Shi | E21B 21/08 |
| 2019/0316459 | A1 * | 10/2019 | Chen | E21B 43/26 |
| 2020/0131899 | A1 * | 4/2020 | Chen | E21B 47/10 |
| 2021/0238982 | A1 * | 8/2021 | Schulte | E21B 33/12 |
| 2023/0058311 | A1 | 2/2023 | Haustveit et al. | |
| 2023/0374880 | A1 | 11/2023 | Kobayashi | |
| 2023/0399939 | A1 * | 12/2023 | Evans | E21B 47/06 |
| 2024/0401436 | A1 * | 12/2024 | Bin Ziad | G01L 19/0092 |

* cited by examiner

*Primary Examiner* — Steven A Macdonald

(57) ABSTRACT

A data logger and a data acquisition hydraulic fracturing process. In a state in which a bridge plug is fixed in a wellbore, both ends of the bridge plug are monitored and data is stored by the data logger, then the data logger is retrieved to analyze the data to evaluate plugging effect of the bridge plug and downhole environment status.

8 Claims, 3 Drawing Sheets

DATA LOGGER AND DATA ACQUISITION HYDRAULIC FRACTURING PROCESS

TECHNICAL FIELD

The present invention belongs to the field of hydraulic fracturing, and in particular relates to a data logger and a data acquisition hydraulic fracturing process.

BACKGROUND

Bridge plug and staged pressure perforation process is an efficient oil and gas development method. It has the technical characteristics of safe and reliable construction, accurate perforating depth, good staged fracturing stimulation effect, low construction cost, etc. The bridge plug and staged pressure perforation process is mainly used in the development of horizontal wells and high-angle unconventional oil and gas reservoirs.

The bridge plug and staged pressure perforation process has the following specific steps: S1, putting a perforating gun and the bridge plug into a wellbore through a cable, S2, fixing the bridge plug at a predetermined position and separating from the perforating gun, S3, lifting the perforating gun to a perforation position and performing multi-cluster perforation, S4, lifting to retrieve the perforating gun and the cable, S5, putting a bridge plug ball and introducing a fracturing fluid into the wellbore to perform perforation fracturing, and S6, putting a drilling bit into the wellbore through the cable and crushing the bridge plug.

The shortcomings of the existing bridge plug and staged pressure perforation process are that it is difficult to monitor and collect data in downhole operation, making it impossible to effectively evaluate the plugging effect of the bridge plug and the downhole environment status.

SUMMARY

In view of the deficiencies of the prior art, it is an object of the present invention to provide a data logger and a data acquisition hydraulic fracturing process. In a state in which a bridge plug is fixed in a wellbore, both ends of the bridge plug are monitored and data is stored by the data logger, then the data logger is retrieved to analyze the data to evaluate plugging effect of the bridge plug and downhole environmental state.

In order to achieve the above object, the present invention provides the following technical solutions.

A data logger, in a sinking state in a working fluid, includes: a housing made of a soluble material and a microchip capsule provided in the housing, and the microchip capsule is in a floating state in the working fluid; where a transducer is provided in the microchip capsule, the transducer is configured to monitor a peripheral environment of the microchip capsule and store the monitored data in the microchip capsule, and the transducer comprises a pressure transducer and/or a temperature transducer.

A data acquisition hydraulic fracturing process includes the following steps: S1, putting a bridge plug into a wellbore, where the bridge plug is a soluble bridge plug; S2, fixing the bridge plug at a predetermined position; S3, putting a data logger into the wellbore, where the data logger passes through a bridge plug hole of the bridge plug; S4, putting a bridge plug ball into the wellbore and introducing a fracturing fluid into the wellbore; S5, monitoring a peripheral environment in real time by the data logger and storing the monitored data; S6, introducing a drilling fluid into the wellbore after the bridge plug is slowly dissolved to retrieve the data logger; and S7, obtaining the data in the data logger for analysis.

The following advantages have been achieved by adopting the above technical solutions:

1. The microchip capsule is wrapped by the housing to realize the purpose of protecting the microchip capsule, and the microchip capsule monitors the surrounding environment in real time by the transducer, the pressure transducer monitors the pressure around the microchip capsule, and the temperature transducer monitors the temperature around the microchip capsule, and they store the monitored data, so that the data transducers are placed at both ends of the bridge plug to monitor the temperature and pressure changes at both ends of the bridge plug under the action of the fracturing fluid in real time, and the plugging effect of the bridge plug and the downhole environment status can be better evaluated according to the obtained data.
2. The housing is made of a soluble material, so that the housing effectively wraps the microchip capsule in a solid state for a certain period of time, allowing the microchip capsule to monitor the surrounding environment stably and effectively within that time, and then the housing is slowly dissolved in the working fluid to make the microchip capsule float in the working fluid, making it easier to retrieve the floating microchip capsule.
3. The high gravity of the housing causes the combined data logger to sink in the working fluid, making it easy for the data logger to descend to the bridge plug in the wellbore to monitor the environment at the bridge plug.

Figure 1:
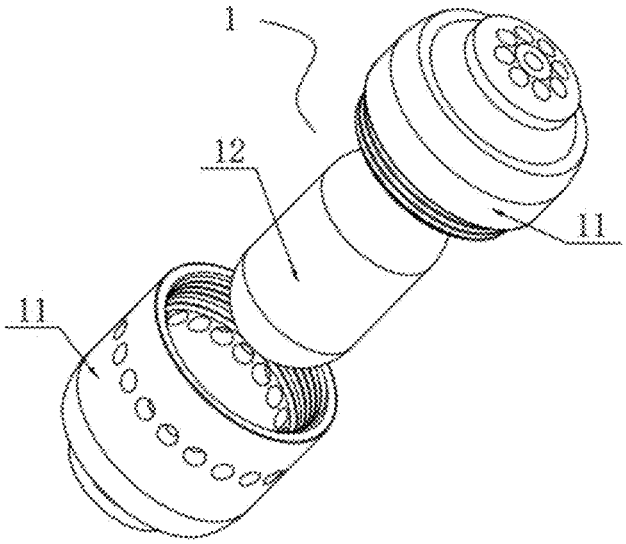
FIG. 1 is an exploded view of Embodiment 1 of the present invention.

Description of reference numerals: 1. data logger; 11. housing; 12. microchip capsule; 111. upper cover; 112. bottom shell; 113. built-in cavity; 114. communication hole; 121. capsule body; 122. pressure transducer; 123. temperature transducer; 124. motherboard; 125. battery module; 126. wireless charging module; 127. LED indicator light; 128. infrared transmitting module; 129. infrared receiving module; 2. bridge plug; 3. bridge plug ball; 4. wellbore; 41. vertical section; and 42. horizontal section.

DESCRIPTION OF THE EMBODIMENTS

Embodiment 1

Figure 2:
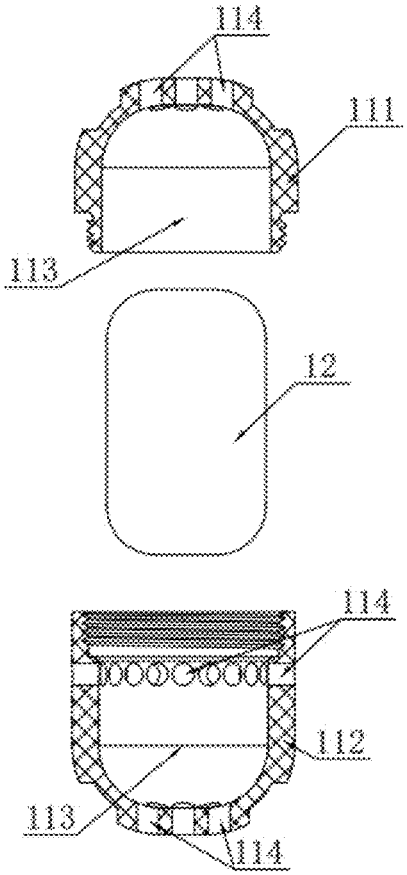
FIG. 2 is a cross-sectional view of Embodiment 1 of the present invention.
Figure 3:
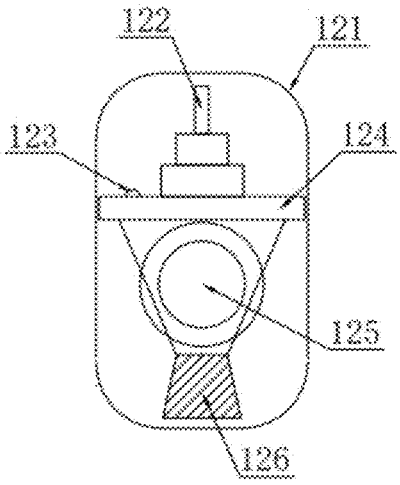
FIG. 3 is a schematic diagram of a microchip capsule according to Embodiment 1 of the present invention.
Figure 4:
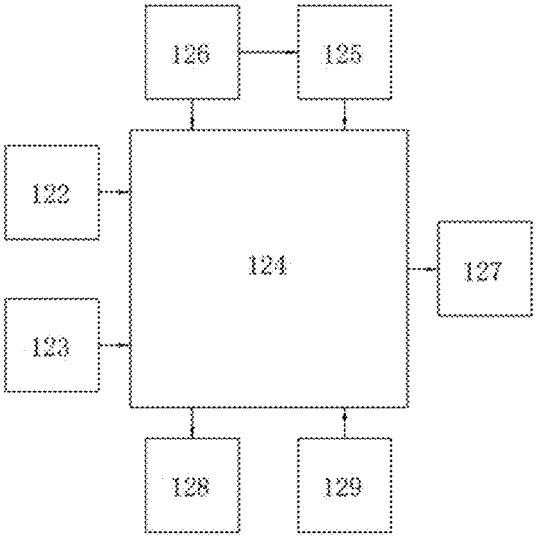
FIG. 4 is a block diagram of the microchip capsule according to Embodiment 1 of the present invention.

As shown in FIGS. 1-4, the present invention discloses a data logger in a sinking state in a working fluid, which includes a housing 11 and a microchip capsule 12, the microchip capsule 12 is arranged on the housing 11, a transducer is provided on the microchip capsule 12, the transducer is configured to monitor a peripheral environment of the microchip capsule 12, and stores the monitored data in the microchip capsule 12, and the transducers specifically used in the present embodiment include a pressure transducer 122 and a temperature transducer 123; the housing 11 is made of a soluble material; and the microchip capsule 12 is in a floating state in the working fluid.

Therefore, 1. the microchip capsule 12 is wrapped by the housing 11 to realize the purpose of protecting the microchip capsule 12, and the microchip capsule 12 monitors the surrounding environment in real time by the transducers, for example, the pressure transducer 122 in the present embodiment monitors the pressure around the microchip capsule 12, and the temperature transducer 123 monitors the temperature around the microchip capsule 12, and they store the monitored data, so that the data transducers are placed at both ends of a bridge plug 2 to monitor the temperature and pressure changes at both ends of the bridge plug 2 under the action of a fracturing fluid in real time, and the plugging effect of the bridge plug 2 and the downhole environment status can be better evaluated according to the obtained data; 2. the housing 11 is made of a soluble material. so that the housing 11 effectively wraps the microchip capsule 12 in a solid state for a certain period of time, allowing the microchip capsule 12 to monitor the surrounding environment stably and effectively within that time, and then the housing 11 is slowly dissolved in the working fluid to make the microchip capsule 12 float in the working fluid, making it easier to retrieve the floating microchip capsule 12; and 3. the high gravity of the housing 11 causes the combined data logger 1 to sink in the working fluid, making it easy for the data logger 1 to descend to the bridge plug 2 in a wellbore 4 to monitor the environment at the bridge plug 2.

In other embodiments, different transducers are added, decreased/replaced according to different data to be monitored.

Here, in the present embodiment, a built-in cavity 113 is provided in the housing 11, the microchip capsule 12 is placed in the built-in cavity 113, a communication hole 114 is provided on the housing 11, and the communication hole 114 is configured to communicate the built-in cavity 113 with an outer side of the housing 11, so that the microchip capsule 12 is protected by the built-in cavity 113, and the communication hole 114 allows external pressure and temperature to be passed into the built-in cavity 113, thus ensuring monitoring accuracy of the transducers.

Specifically, the housing 11 in the present embodiment includes an upper cover 111 and a bottom shell 112, and the upper cover 111 and the bottom shell 112 are in threaded connection to open or close the built-in cavity 113, so that the microchip capsule 12 is placed in the built-in cavity 113 in a state where the upper cover 111 and the bottom shell 112 are separated, and then the built-in cavity 113 is closed by the threaded connection of the upper cover 111 and the bottom shell 112, which further facilitates assembly of the data logger 1. Here, a top portion of the upper cover 111 is provided with a plurality of communication holes 114 that penetrate and communicate with the built-in cavity 113 downward, a peripheral wall of the bottom shell 112 is provided with a plurality of communication holes 114 that penetrate and communicate with the built-in cavity 113 inward, and a bottom portion of the bottom shell 112 is provided with a plurality of communication holes 114 that penetrate and communicate with the built-in cavity 113 upward.

Here, a motherboard 124, a battery module 125, a wireless charging module 126, an LED indicator light 127, an infrared transmitting module 128 and an infrared receiving module 129 are provided on the microchip capsule 12 in the present embodiment, and the transducers, the battery module 125, the wireless charging module 126, the LED indicator light 127, the infrared transmitting module 128 and the infrared receiving module 129 are all electrically connected to the motherboard 124. Here, the motherboard 124 has a data storage function, so that the data monitored by the transducers can be stored on the motherboard 124, or an additional storage module can be provided; the wireless charging module 126 is configured to charge the battery module 125; the battery module 125 is configured to supply power to a circuit; the LED indicator light 127 indicates the status, for example, when the circuit is powered on, the LED indicator light 127 displays a green light; and the infrared transmitting module 128 and the infrared receiving module 129 are configured to provide signals for subsequent capture of the microchip capsule 12, making it easier for staff to locate.

Here, the microchip capsule 12 in the present embodiment includes a capsule body 121, and the capsule body 121 wraps various circuit parts to play a waterproof function. The capsule body 121 is made by mixing polymer resin and low-density hollow glass microspheres. For example, the low-density hollow glass microspheres are uniformly distributed in the polymer resin to form a polymer resin containing the hollow glass microspheres, or may be non-uniformly distributed such as the low-density hollow glass microspheres concentrated and coated with the polymer resin, making the microchip capsule 12 resistant to high temperature, high pressure and corrosion, thus adapting to harsh environment of oil wells for data acquisition.

Here, the housing 11 in the present embodiment is made of a soluble magnesium metal alloy.

Embodiment 2

Figure 5:
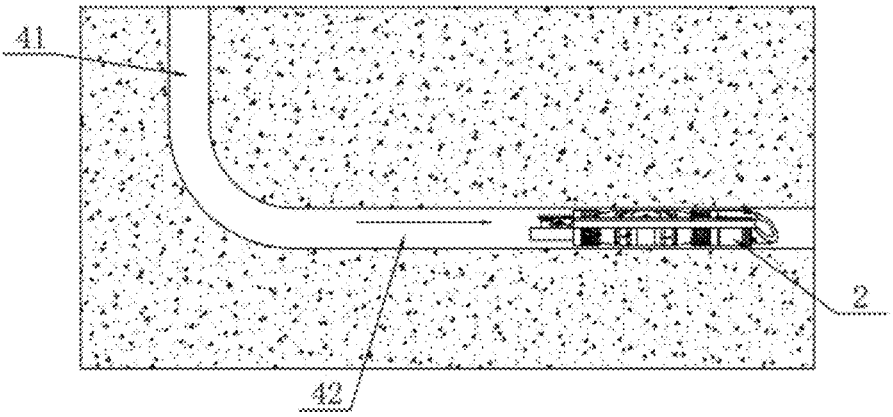
FIG. 5 is a flowchart of Embodiment 2 of the present invention.
Figure 6:
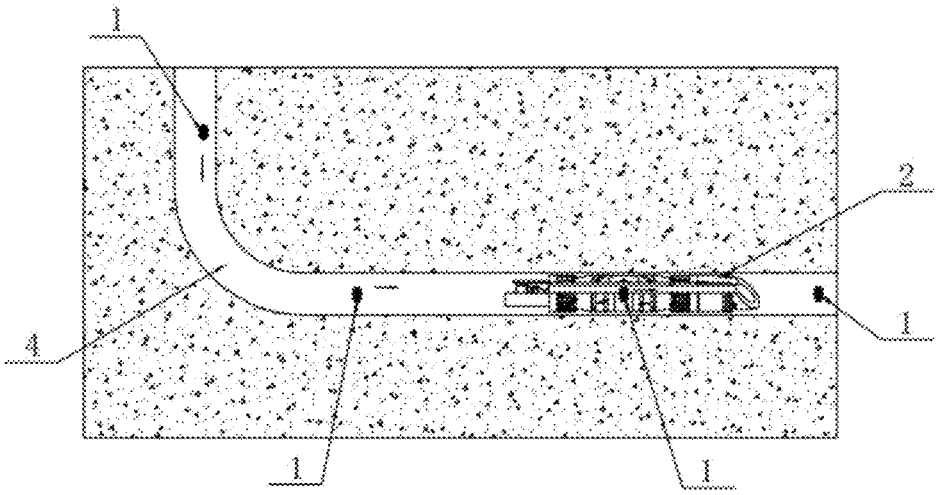
FIG. 6 is a flowchart of Embodiment 2 of the present invention.
Figure 7:
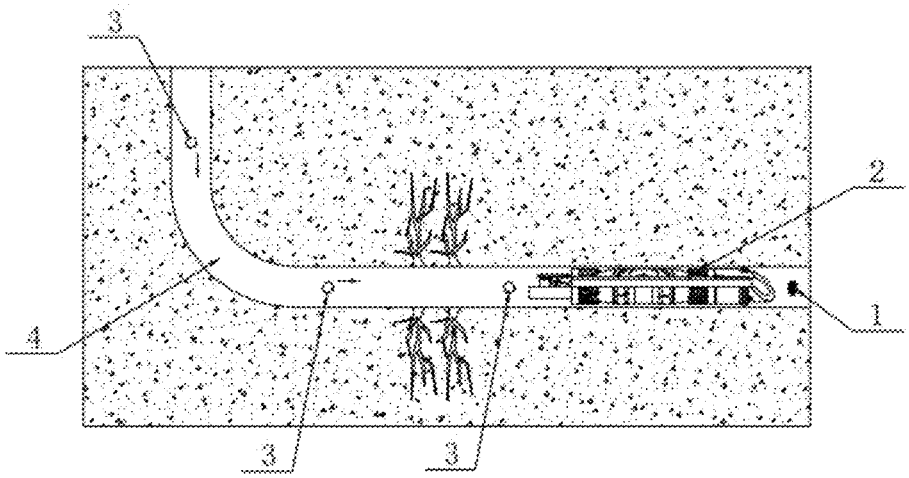
FIG. 7 is a flowchart of Embodiment 2 of the present invention.
Figure 8:
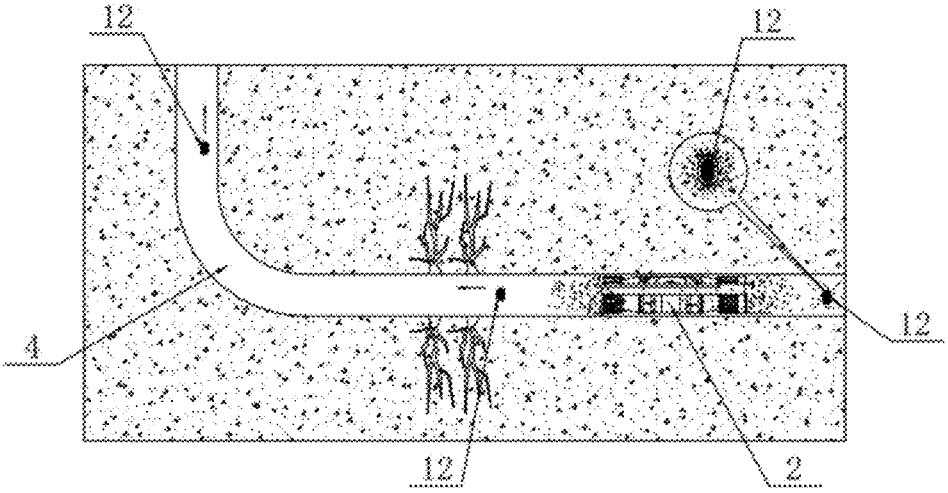
FIG. 8 is a flowchart of Embodiment 2 of the present invention.

As shown in FIGS. 5-8, a data acquisition hydraulic fracturing process is used to perform fracturing operation in a wellbore 4. Here, it is necessary to use a bridge plug 2, the data logger described in Embodiment 1, a bridge plug ball 3, a perforating gun and a cable, and the bridge plug 2 is a soluble bridge plug.

Specifically, the data acquisition hydraulic fracturing process includes the following steps: S1, putting the bridge plug 2 into the wellbore 4, where specifically the bridge plug 2 passes through a vertical section 41 of the wellbore 4 and enters a horizontal 1 section 42; S2, allowing the bridge plug 2 to reach a predetermined position of the horizontal section 42 and fixing the same; S3, turning on the data logger 1 and putting the same into the wellbore 4, allowing the data logger 1 to pass through the vertical section 41 of the wellbore 4 and enter the horizontal section 42, and then allowing the data logger 1 to pass through a bridge plug hole of the bridge plug 2 in the horizontal section 42; S4, putting the bridge plug ball 3 into the wellbore 4, and introducing a fracturing fluid into the wellbore 4; S5, monitoring a peripheral environment in real time by the data logger 1 and storing the monitored data; S6, introducing a drilling fluid into the wellbore 4 after the bridge plug 2, the bridge plug ball 3 and a housing 11 are slowly dissolved to retrieve the data logger 1; and S7, obtaining the data in the data logger 1 for analysis.

Therefore, after the bridge plug 2 is fixedly mounted, the data logger 1 is turned on and put into the wellbore 4, and temperature and pressure in the process of the arrival of the data logger 1 to the bridge plug 2, the process of introducing the fracturing fluid, the process of slow dissolution of the bridge plug 2, and the process of retrieving the data logger 1 are monitored in real time, and the data is stored, so that after the data is obtained through retrieval, the data in the processes can be analyzed and evaluated to facilitate the discovery of problems from the data and improvement.

Here, step S1 can be specifically divided into the following steps: S11, putting a perforating gun and the bridge plug 2 into the wellbore 4 from a wellhead of the wellbore 4; and S12, conveying the perforating gun and the bridge plug 2 within the wellbore 4 through a cable or a pipe string.

Here, step S2 can be specifically divided into the following steps: S21, fixing the bridge plug 2 by setting after the bridge plug 2 reaches the predetermined position; S22, lifting the perforating gun to a perforation position through the cable or the pipe string and performing multi-cluster perforation; and S23, lifting the perforating gun through the cable or the string to retrieve the perforating gun from the wellhead of the wellbore 4.

Here, the fracturing fluid introduced in step S4 is used to perform fracturing on the perforation.

Here, the microchip capsule 12 is in a floating state in a working fluid so that in step S6, the microchip capsule 12 moves toward the wellhead of the wellbore 4 by own buoyancy thereof and flow of the drilling fluid, making the retrieval smoother.

However, the housing 11 has a large mass, so the data logger 1 is in a sinking state in the working fluid. Therefore, the data logger 1 can sink more smoothly.

What is claimed is:

1. A data acquisition hydraulic fracturing process, comprising the following steps:

S1, putting a bridge plug into a wellbore, the bridge plug being a soluble bridge plug;

S2, fixing the bridge plug at a predetermined position;

S3, putting a data logger into the wellbore, the data logger passing through a bridge plug hole of the bridge plug;

S4, putting a bridge plug ball into the wellbore and introducing a fracturing fluid into the wellbore;

S5, monitoring a peripheral environment in real time by the data logger and storing the monitored data;

S6, introducing a drilling fluid into the wellbore after the bridge plug is slowly dissolved to retrieve the data logger; and S7, obtaining the data in the data logger for analysis.

2. The data acquisition hydraulic fracturing process according to claim 1, wherein step S1 specifically includes the following steps:

S11, putting a perforating gun and the bridge plug into the wellbore from a wellhead of the wellbore; and S12, conveying the perforating gun and the bridge plug within the wellbore through a cable or a pipe string; and step S2 specifically includes the following steps:

S21, fixing the bridge plug by setting after the bridge plug reaches the predetermined position;

S22, lifting the perforating gun to a perforation position through the cable or the pipe string and performing multi-cluster perforation; and S23, lifting the perforating gun through the cable or the string to retrieve the perforating gun from the wellhead of the wellbore; and the fracturing fluid introduced in step S4 is used to perform fracturing on the perforation.

3. The data acquisition hydraulic fracturing process according to claim 1, wherein the data logger comprises a microchip capsule, a transducer is provided in the microchip capsule, the transducer is configured to monitor the peripheral environment of the bridge plug and store the monitored data in the microchip capsule, and the transducer comprises a pressure transducer and/or a temperature transducer; and the microchip capsule is in a floating state in a working fluid so that in step S6, the microchip capsule moves toward the wellhead of the wellbore by own buoyancy thereof and flow of the drilling fluid.

4. The data acquisition hydraulic fracturing process according to claim 3, wherein the data logger comprises a housing, the microchip capsule is provided in the housing, and the data logger is in a sinking state in the working fluid; and the housing is made of a soluble material.

5. The data acquisition hydraulic fracturing process according to claim 4, wherein a built-in cavity is provided in the housing, the microchip capsule is placed in the built-in cavity, a communication hole is provided in the housing, and the communication hole is configured to communicate the built-in cavity with an outer side of the housing; and the housing comprises an upper cover and a bottom shell, and the upper cover and the bottom shell are detachably connected to open or close the built-in cavity.

6. The data acquisition hydraulic fracturing process according to claim 4, wherein the housing is made of a soluble magnesium metal alloy.

7. The data acquisition hydraulic fracturing process according to claim 3, wherein a motherboard, a battery module, a wireless charging module, an LED indicator light, an infrared transmitting module and an infrared receiving module are provided in the microchip capsule; the transducer, the battery module, the wireless charging module, the LED indicator light, the infrared transmitting module and the infrared receiving module are all electrically connected to the motherboard; and the motherboard stores the data monitored by the transducer.

8. The data acquisition hydraulic fracturing process according to claim 3, wherein the microchip capsule comprises a capsule body, and the capsule body is made of a mixture of polymer resin and low-density hollow glass microspheres.

* * * * *